US009397451B2

(12) United States Patent
Akagi et al.

(10) Patent No.: US 9,397,451 B2
(45) Date of Patent: Jul. 19, 2016

(54) CONNECTOR DEVICE

(71) Applicant: YAZAKI CORPORATION, Minato-ku, Tokyo (JP)

(72) Inventors: Yosuke Akagi, Shizuoka (JP); Nobuyuki Sakamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/862,449

(22) Filed: Sep. 23, 2015

(65) Prior Publication Data

US 2016/0093972 A1 Mar. 31, 2016

(30) Foreign Application Priority Data

Sep. 26, 2014 (JP) ..... 2014-196095

(51) Int. Cl.
*H01R 13/73* (2006.01)
*H01R 13/74* (2006.01)
*H01R 13/502* (2006.01)

(52) U.S. Cl.
CPC ..... *H01R 13/74* (2013.01); *H01R 13/502* (2013.01); *H01R 13/743* (2013.01)

(58) Field of Classification Search
CPC .... H01R 13/74; H01R 13/741; H01R 13/743; H01R 13/6271; H01R 13/6272; H01R 23/7021; H01R 13/748; H01R 23/02; H01R 24/60
USPC ..... 439/660, 357, 544, 545, 549, 557, 562
See application file for complete search history.

(56) References Cited

U.S. PATENT DOCUMENTS 6,241,551 B1 * 6/2001 Watanabe ..... H01R 13/506 439/350
7,384,303 B2 * 6/2008 Murakami ..... H01R 13/743 439/557
7,575,473 B2 * 8/2009 Kodama ..... H01R 13/6273 439/372
7,611,370 B2 * 11/2009 Ito ..... H01R 13/6272 439/345
2008/0305672 A1 * 12/2008 Kodama ..... H01R 13/6273 439/357
2009/0011632 A1 1/2009 Ito et al.

FOREIGN PATENT DOCUMENTS

JP 2009-016198 A 1/2009

* cited by examiner

*Primary Examiner* — Tulsidas C Patel
*Assistant Examiner* — Travis Chambers
(74) *Attorney, Agent, or Firm* — MOTS Law, PLLC

(57) ABSTRACT

A first connector housing (4) includes a rotation prevention lock arm (200) configured to flexurally-deform into a state allowing to temporary lock the rotation prevention lock arm (200) to a peripheral edge (7*b*) of a mounting hole (7) and to locate a temporary locking position to a position allowing to prevent rotation around the temporary locking position of a lock arm (9) as a supporting point (P1, 7*a*), and a second connector housing (3) includes a rotation prevention pressing portion (250) configured to flexurally-deform the rotation prevention lock arm (200), and the rotation prevention pressing portion (250) temporarily locks the rotation prevention lock arm (200) to the peripheral edge (7*b*) of the mounting hole (7) in timing when a lock arm locking portion (8) temporarily locks the lock arm (9) to the peripheral edge (7*a*) of the mounting hole (7).

3 Claims, 13 Drawing Sheets

CONNECTOR DEVICE

CROSS REFERENCE TO RELATED APPLICATIONS

This application claims the priority of Japanese Patent Application No. 2014-196095, filed on Sep. 26, 2014, the entire content of which are incorporated herein by reference.

BACKGROUND

1. Technical Field

The present invention relates to a connector device used to connect wires and the like.

2. Related Art

Vehicles and the like use a connector device (connector) having a first connector housing and a second connector housing that fit into each other by sandwiching a mounting member such as a pillar or a panel, constituting a portion of a body therebetween.

For example, a connector device in which the first connector housing is temporarily locked into a mounting hole of a panel and the second connector housing is fitted into the first connector housing is known (refer to JP 2009-16198 A).

The connector disclosed by JP 2009-16198 A is configured as shown in FIGS. 8 to 12.

FIG. 8 is a perspective view showing a connector 101 including a first connector housing 104 and a second connector housing 103 and FIGS. 9 to 12 are sectional views showing processes in which the second connector housing 103 is successively fitted into the first connector housing 104 that is temporarily locked.

The connector 101 shown in FIGS. 8 and 9 constitutes a wire harness cabled to vehicles and the like. The connector 101 includes, as shown in FIG. 8, the first connector housing 104 and the second connector housing 103 that fit into each other while a body panel (hereinafter, called a panel) 102 constituting a body being sandwiched therebetween.

The panel 102 is provided with, as shown in FIG. 8, a mounting hole 107 passing through the panel 102. The first connector housing 104 and the second connector housing 103 are fitted into each other by being inserted through the mounting hole 107 of the panel 102 while the panel 102 is positioned therebetween before being fixed to the panel 102.

The first connector housing 104 is molded from synthetic resin and includes a body portion 141, a pair of temporary locking portions 112, and a lock arm 109.

The lock arm 109 includes an arm portion 191 in a plate shape installed upright from an upper wall 144 and extended along a fitting direction toward the side on which the second connector housing 103 is mounted, a pair of lock portions 192 projecting in a direction perpendicular to the fitting direction from a tip portion 191*a* of the arm portion 191 along the surface direction of the upper wall 144, and a projecting portion 193 projecting to an outer side of the body portion 141 from the tip portion 191*a* of the arm portion 191 along the height direction.

The lock arm 109 is fitted into the second connector housing 103 while the first connector housing 104 is temporarily locked into the panel 102. In the fitting process, as shown in FIGS. 9 and 10, the lock portion 192 is flexurally-deformed upward by being run up onto a rib 108 as an engaging portion on the second connector housing 103 side after being brought into sliding contact therewith. Then, the lock arm 109 prevents the first connector housing 104 whose temporary lock into the panel 102 by the temporary locking portion 112 is released from dropping off from the panel 102 by being brought into contact with and pressed against the peripheral edge of the mounting hole 107 of the panel 102 by the flexural deformation.

On the other hand, the second connector housing 103 is also molded from synthetic resin and includes a body portion 132, a flange portion 131, a pair of actual locking portions 111 (see FIG. 8), a pair of the ribs 108 engaged with the lock arm 109, and a fitting portion 110 of the lock portion 192.

Then, as shown in FIG. 11, in the final process of fitting of the first connector housing 104 and the second connector housing 103, the lock portion 192 of the lock arm 109 on the first connector housing 104 side is fitted into the fitting portion 110 on the second connector housing 103 side so that the first connector housing 104 and the second connector housing 103 are coupled.

Further, by pressing the coupled body of the first connector housing 104 and the second connector housing 103 in the A direction shown in FIG. 11, as shown in FIG. 12, the flange portion 131 on the first connector housing 104 side is moved to the position opposite to the panel 102 in the neighborhood thereof. In this state, the actual locking portion 111 on the second connector housing 103 side and the peripheral edge of the mounting hole 107 of the panel 102 are engaged and the connector 101 is fixed to the panel 102. Incidentally, as shown in FIG. 12, a grommet 210 is mounted on the flange portion 131.

In a state of the first connector housing 104 and the second connector housing 103 being fitted as shown in FIG. 10, the arm portion 191 of the lock arm 109 is flexurally-deformed upward by being run up onto the rib 108 on the second connector housing 103 side after being brought into sliding contact therewith and is in contact with and pressed against the peripheral edge of the mounting hole 107 of the panel 102.

However, if a pressing force F1 in the fitting direction as shown in FIG. 13 is applied to deepen the fitting of the first connector housing 104 and the second connector housing 103 from the above state, a turning force F2 around a contact point of the top surface of the arm portion 191 and the peripheral edge of the mounting hole 107 as a supporting point P1 arises in the coupled body of the first connector housing 104 and the second connector housing 103.

An inclination θ with respect to the panel 102 arises in a portion (for example, a projecting portion 150) that should be in parallel with the panel 102.

Under the influence of the inclination θ, the vector in the fitting direction by the pressing force F1 is dispersed and the force in the direction in which the first connector housing 104 and the second connector housing 103 are fitted is weakened, causing a problem that facilitation and efficiency of fitting work are inhibited.

The present invention is made in view of the above problem and an object thereof is to provide a connector device capable of improving facilitation and efficiency of fitting work.

SUMMARY

A connector device according to the one aspect of the present invention includes a first connector housing having a first body portion, a lock arm, and a temporary locking portion temporarily locked to a peripheral edge of a mounting hole of a mounting member and inserted from one side of the mounting hole, and a second connector housing having a second body portion, a temporary locking release portion that displaces the temporary locking portion to a release position in a fitting process into the first connector housing, a lock arm locking portion that flexurally-deforms the lock arm into a temporary locking state allowing temporary locking to the peripheral edge of the mounting hole and also locks the lock arm, and an actual locking portion that locks to the peripheral edge of the mounting hole in an insertion complete position of the mounting hole, and configured to insert from the other side of the mounting hole. When the second connector housing is fitted into the first connector housing temporarily locked to the peripheral edge of the mounting hole by the temporary locking portion, the lock arm locking portion flexurally-deform the lock arm in the fitting process so as to be temporarily locked to the peripheral edge of the mounting hole, the temporary locking release portion release the temporary locking of the temporary locking portion in the temporary locking state of the lock arm and the peripheral edge of the mounting hole, the lock arm being recovered from flexural deformation when fitted into an inter-connector fitting position to lock the lock arm into the lock arm locking portion, and when the second connector housing moves to an insertion complete position of the mounting hole, the actual locking portion lock to the peripheral edge of the mounting hole. The first connector housing includes a rotation prevention lock arm configured to flexurally-deform into a state allowing to temporary lock the rotation prevention lock arm (200) to the peripheral edge of the mounting hole and to locate a temporary locking position to a position allowing to prevent rotation around the temporary locking position of the lock arm as a supporting point. The second connector housing includes a rotation prevention pressing portion configured to flexurally-deform the rotation prevention lock arm. The rotation prevention pressing portion temporarily locks the rotation prevention lock arm to the peripheral edge of the mounting hole in timing when the lock arm locking portion temporarily locks the lock arm to the peripheral edge of the mounting hole.

According to a connector device according to an embodiment of the present invention, the rotation prevention lock arm is temporarily locked to the peripheral edge of the mounting hole such that rotation of the first connector housing around a contact point of the lock arm and the peripheral edge of the mounting hole as a supporting point is prevented and therefore, compared with a conventional configuration, facilitation and efficiency of fitting work can be improved.

That is, in a conventionally configured connector, a predetermined inclination with respect to a panel arises in a portion that should be opposed to the panel, corresponding to the mounting member, in parallel therewith due to rotation of the first connector housing around a contact point of the lock arm and the peripheral edge of the mounting hole as the supporting point in a fitting process. Thus, under the influence of the inclination, the vector in the fitting direction by a pressing force is dispersed and the force in the direction in which the first connector housing and the second connector housing are fitted is weakened, causing a problem that facilitation and efficiency of fitting work are inhibited.

In a connector device according to an embodiment of the present invention, by contrast, the rotation prevention pressing portion temporarily locks the lock arm to the peripheral edge of the mounting hole in timing when the lock arm locking portion temporarily locks the lock arm to the peripheral edge of the mounting hole. Thus, the rotation of the first connector housing around the contact point of the lock arm and the peripheral edge of the mounting hole as the supporting point is prevented and circumstances in which the vector of the pressing force in the fitting direction is dispersed in other directions are avoided and therefore, facilitation and efficiency of fitting work can be improved.

The lock arm locking portion of the second connector housing may include a fitting portion configured to fit the lock arm.

According to the connector device, a coupled state of the first connector housing and the second connector housing can reliably be held by the lock arm being fitted into the fitting portion with the progress of the fitting process.

The rotation prevention lock arm may have a first projecting portion that flexurally-deforms the rotation prevention lock arm by being brought into sliding contact with the rotation prevention pressing portion, and a second projecting portion temporarily locked to the peripheral edge of the mounting hole by the rotation prevention lock arm being flexurally-deformed.

According to the connector device, the rotation prevention lock arm can reliably be locked temporarily to the peripheral edge of the mounting hole by the rotation prevention lock arm being flexurally-deformed with the progress of the fitting process.

According to the one aspect of the present invention, a connector device capable of improving facilitation and efficiency of fitting work can be provided.

DETAILED DESCRIPTION

A connector device 1 according to an embodiment of the present invention will be described with reference to FIGS. 1 to 7.

(Configuration Example of the Connector Device)

The connector device 1 according to an embodiment of the present invention has the configuration shown in FIGS. 1 to 6C.

Figure 1:
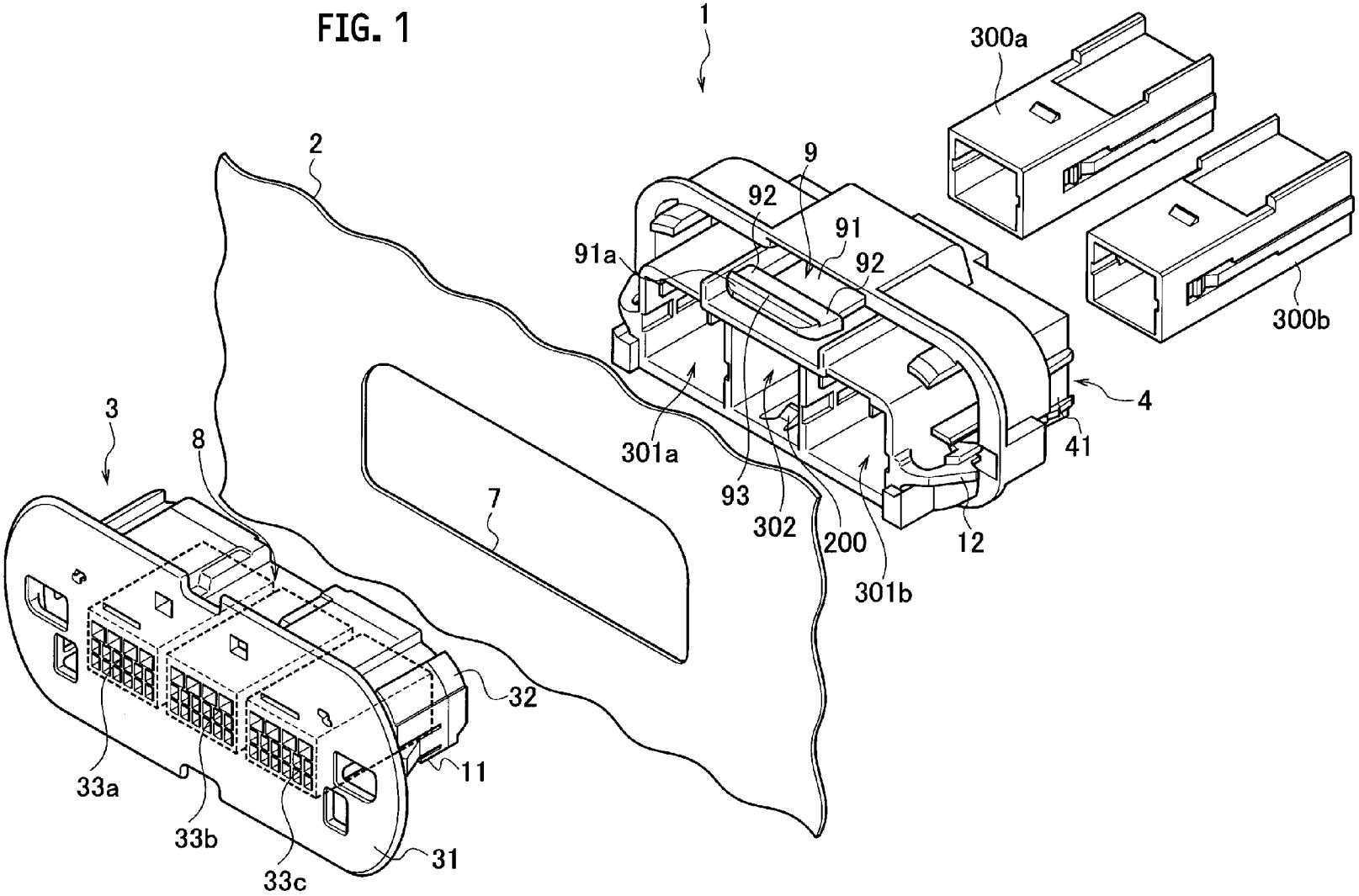
FIG. 1 is an exploded perspective view showing a configuration example of a connector device according to an embodiment of the present invention.

FIG. 1 is an exploded perspective view showing the configuration of the connector device 1 having a first connector housing 4 and a second connector housing 3 and FIGS. 2A to 6C are side views, sectional views and the like showing processes in which the second connector housing 3 is successively fitted into the first connector housing 4 that is temporarily locked.

Figure 2A:
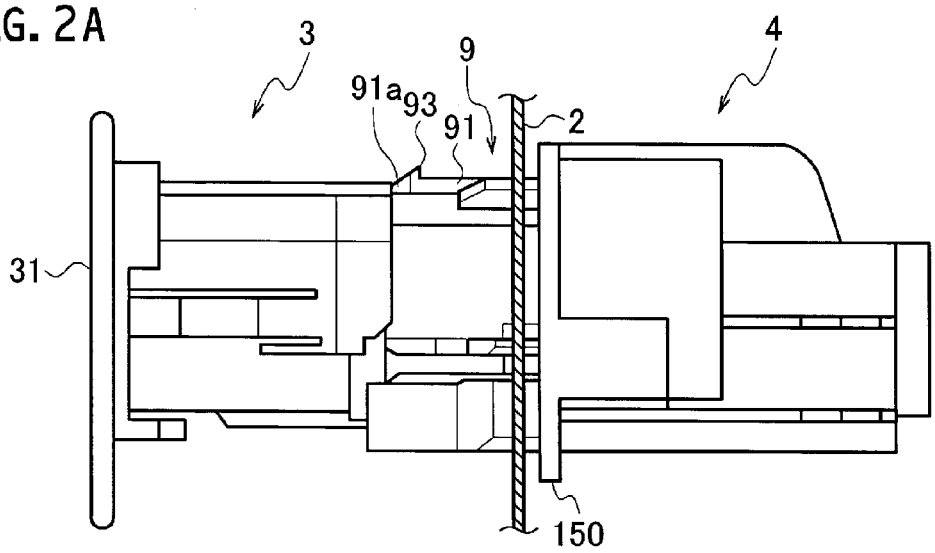
FIG. 2A is a side view showing a fitting process of the connector device according to an embodiment of the present invention.
Figure 2B:
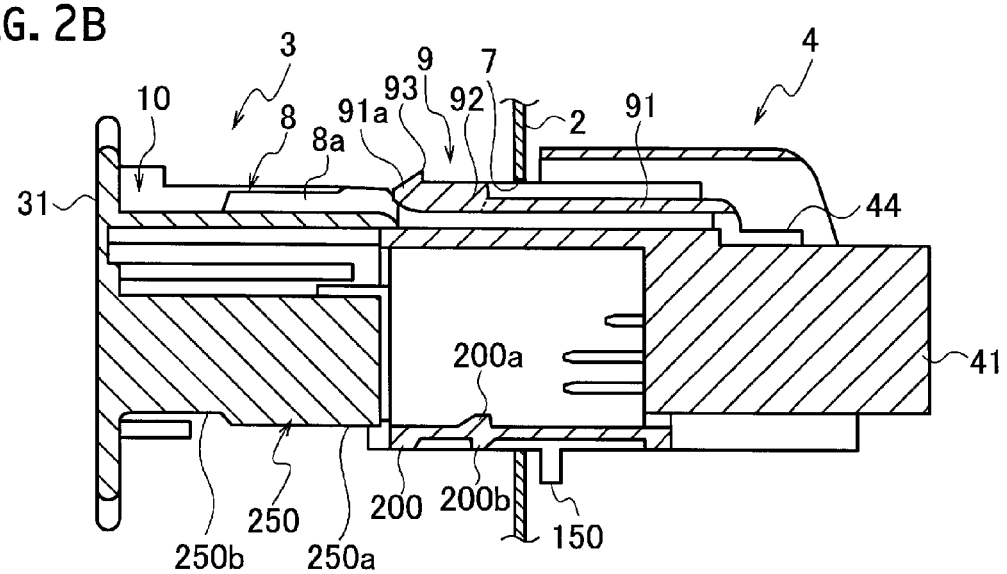
FIG. 2B is a sectional view showing a fitting process of the connector device according to an embodiment of the present invention.
Figure 2C:
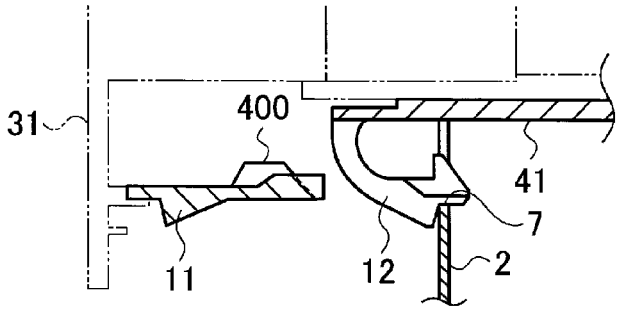
FIG. 2C is an enlarged sectional view of principal portions.

The connector device 1 shown in FIGS. 1 to 2C and the like is used in a wire harness cabled to vehicles and the like.

As shown in FIG. 1 and the like, the connector device 1 is comprised of the first connector housing 4 and the second connector housing 3 fitted into each other while a pillar 2 as a kind of a mounting member constituting a portion of the body is sandwiched therebetween.

The pillar 2 is provided with, as shown in FIG. 1, a mounting hole 7 passing through the pillar 2. The first connector housing 4 and the second connector housing 3 are fitted into each other by being inserted through the mounting hole 7 formed on the pillar 2 while the pillar 2 is positioned therebetween before being fixed to the pillar 2.

The first connector housing 4 is molded from synthetic resin and includes a body portion 41, a pair of temporary locking portions 12, and a lock arm 9.

Sub-connectors holding portions 301*a*, 301*b* capable of holding sub-connectors 300*a*, 300*b* after the sub-connectors being inserted therethrough from the backward side are formed in the body portion 41. Also, an engaging portion 302 provided with a connector portion (not shown) on the rear end side is formed between the sub-connectors holding portions 301*a*, 301*b*.

Incidentally, terminals of cables laid from an on-board device or the like are connected to the sub-connectors 300*a*, 300*b*.

As shown in FIG. 2B, the lock arm 9 includes an arm portion 91 in a plate shape installed upright from an upper wall 44 and extended along a fitting direction toward the side on which the second connector housing 3 is mounted, a pair of lock portions 92 (see FIG. 1) projecting in a direction perpendicular to the fitting direction from a tip portion 91*a* of the arm portion 91 along the surface direction of the upper wall 44, and a projecting portion 93 projecting to an outer side of the body portion 41 from the tip portion 91*a* of the arm portion 91 along the height direction.

In the process in which the lock arm 9 is fitted into the second connector housing 3 while the first connector housing 4 is temporarily locked into the pillar 2, as shown in FIGS. 3B, 3D, 4B, and 4D, the lock portion 92 is flexurally-deformed upward by being run up onto a rib 8*a* as a lock arm locking portion 8 on the second connector housing 3 side described later after being brought into sliding contact therewith. The lock arm 9 prevents the first connector housing 4 whose temporary lock into the pillar 2 by the temporary locking portion 12 is released from dropping off from the pillar 2 by being brought into contact with and pressed against the peripheral edge of the mounting hole 7 formed on the pillar 2 in the fitting process.

Also, a rotation prevention lock arm 200 extending along the fitting direction toward the opposite direction to the side on which the second connector housing 3 is mounted is provided at the bottom face of the engaging portion 302 is formed.

The rotation prevention lock arm 200 has, as shown in FIG. 2B, projecting portions 200*a*, 200*b* formed in a portion where flexurally-deformed and displaced and is configured so as to be engaged with a rotation prevention pressing portion 250 on the second connector housing 3 side described later and the peripheral edge of the mounting hole 7.

Figure 3A:
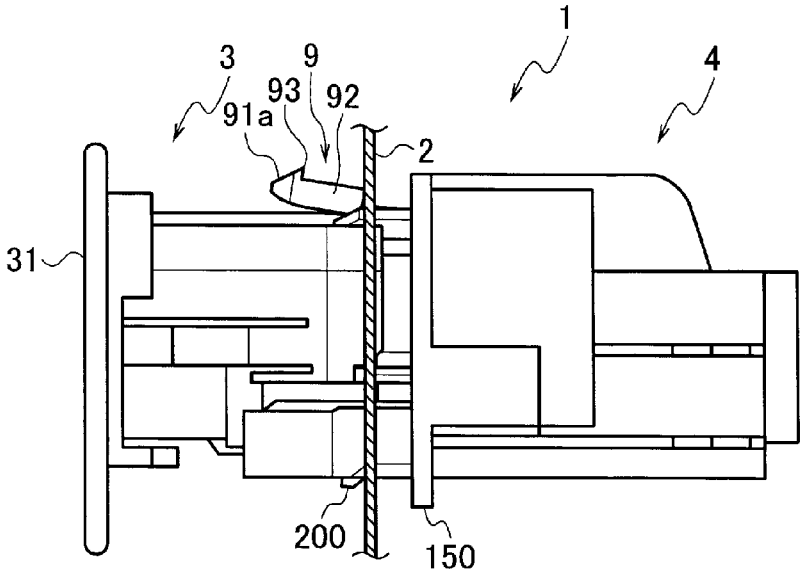
FIG. 3A is a side view showing a continuation of the fitting process of the connector device according to an embodiment of the present invention.
Figure 3B:
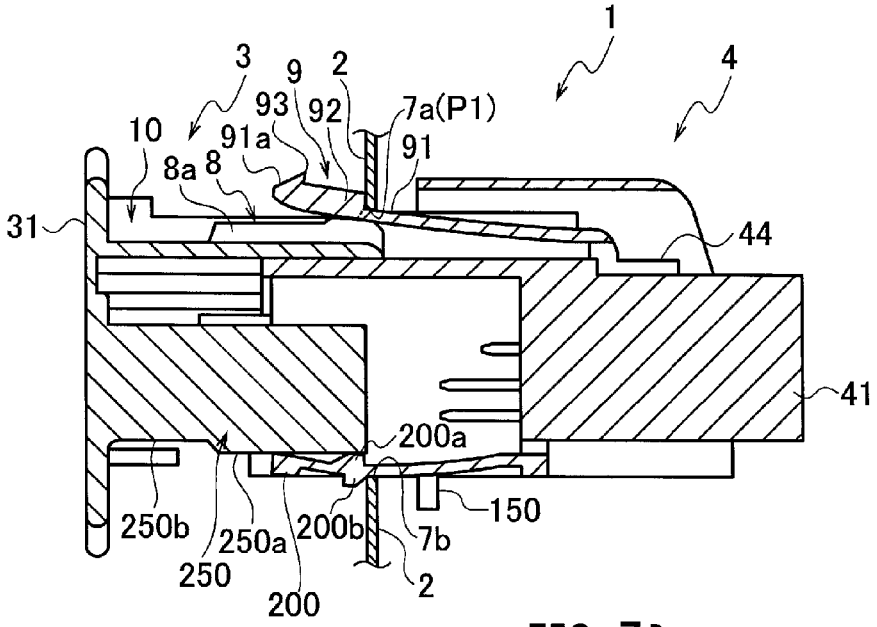
FIG. 3B is a sectional view showing a continuation of the fitting process of the connector device according to an embodiment of the present invention.
Figure 4A:
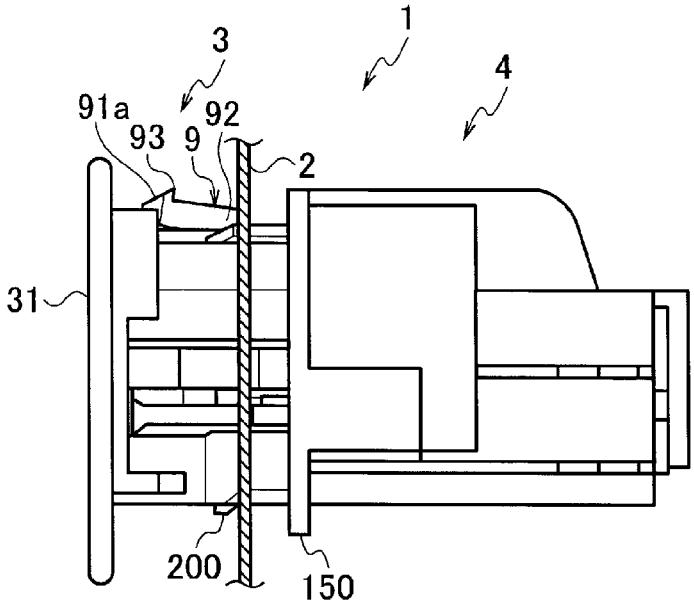
FIG. 4A is a side view showing a continuation of the fitting process of the connector device according to an embodiment of the present invention.
Figure 4B:
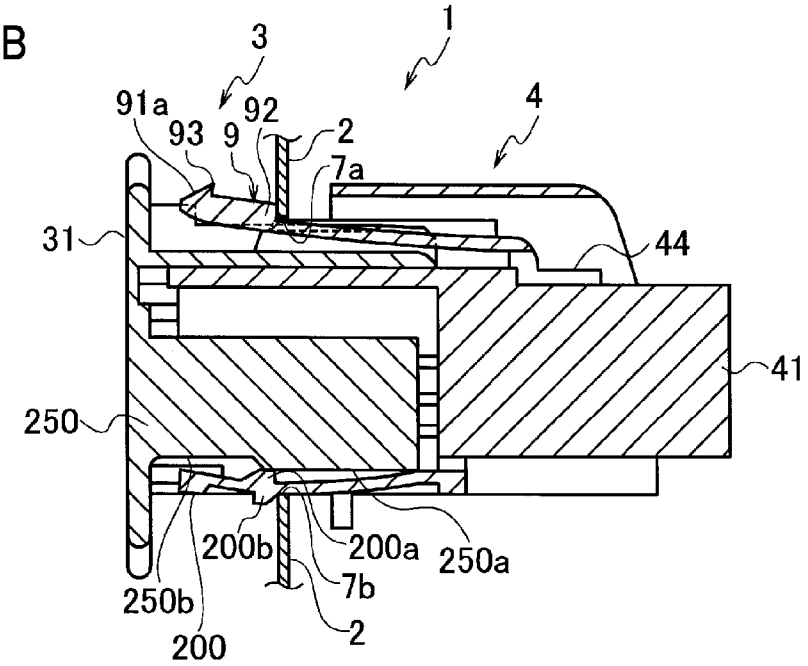
FIG. 4B is a sectional view showing a continuation of the fitting process of the connector device according to an embodiment of the present invention.

The rotation prevention lock arm 200 comes into sliding contact with a sliding contact surface 250*a* of the rotation prevention pressing portion 250 on the second connector housing 3 side and is bent to the outer side (downward side in FIG. 3B) in the timing of engagement with the peripheral edge of the mounting hole 7 by the temporary locking portion 12 being released. Then, as shown in FIGS. 3B and 4B, the projecting portion 200*b* of the rotation prevention lock arm 200 and the peripheral edge of the mounting hole 7 come into contact in a pressed state. With the contact of the rotation prevention lock arm 200 and the peripheral edge of the mounting hole 7, a situation in which the first connector housing 4 rotates around a contact point 7*a* as a supporting point P1 can be prevented. Details thereof will be described later.

On the other hand, the second connector housing 3 is also molded from synthetic resin and includes a body portion 32, a flange portion 31, and an actual locking portion 11 that flexurally-deforms a temporary locking release portion 400 that displaces the temporary locking portion 12 to a release position in the fitting process into the first connector housing 4 and the lock arm 9 into a state allowing temporary locking to the peripheral edge of the mounting hole 7 and also locks to the peripheral edge of the mounting hole 7 in an insertion complete position of the lock arm locking portion 8 that locks the lock arm 9 and the mounting hole 7.

Incidentally, the lock arm locking portion 8 has a dented fitting portion 10 that fits into the lock arm 9 formed at an end portion thereof.

The flange portion 31 is integrally provided with connector portions 33*a* to 33*c* that connect terminals of cables of various peripheral devices.

In the present embodiment, the temporary locking release portion 400 is formed integrally with the actual locking portion 11.

(Fitting Process of the Connector Device)

The fitting process of the first connector housing 4 and the second connector housing 3 configured as described above will be described with reference to FIGS. 2A to 6C.

First, FIGS. 2A to 2C show a state of initial fitting.

In the fitting process shown in FIGS. 2A to 2C, the first connector housing 4 is inserted into the mounting hole 7 formed on the pillar 2 and the pair of temporary locking portions 12 undergoes flexural deformation caused by contact with the peripheral edge of the mounting hole 7 before being engaged with the peripheral edge of the mounting hole 7 formed on the pillar 2 as shown in FIG. 2C.

Accordingly, the first connector housing 4 is temporarily locked into the pillar 2.

Next, the fitting of the second connector housing 3 into the first connector housing 4 temporarily locked as described above is started.

In the state shown in FIG. 2B, the tip portion 91*a* of the lock arm 9 on the first connector housing 4 side starts to contact the tip of the lock arm locking portion 8 on the second connector housing 3 side.

The rotation prevention lock arm 200 on the first connector housing 4 side and the sliding contact surface 250*a* of the rotation prevention pressing portion 250 on the second connector housing 3 side are not yet in contact.

Also, as shown in FIG. 2C, the temporary locking portion 12 on the first connector housing 4 side and the temporary locking release portion 400 are not yet in contact.

Figure 3C:
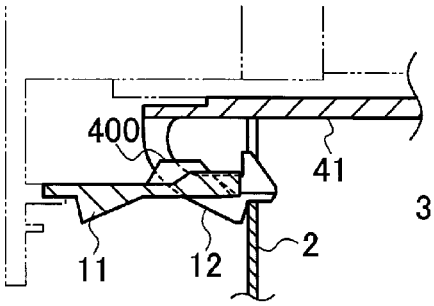
FIG. 3C is an enlarged sectional view of principal portions.
Figure 3D:
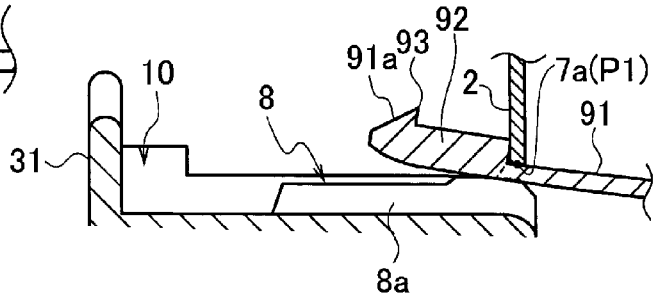
FIG. 3D is an enlarged sectional view of other principal portions.

Next, in the fitting process shown in FIGS. 3A to 3D, the arm portion 91 of the lock arm 9 on the first connector housing 4 side comes into sliding contact with the top surface of the rib 8*a* as the lock arm locking portion 8 on the second connector housing 3 side and the arm portion 91 is bent upward before being pressed against one peripheral edge (the contact point) 7*a* of the mounting hole 7 formed on the pillar 2 and locked thereinto (see FIGS. 3B and 3D).

Also, the projecting portion 200*a* of the rotation prevention lock arm 200 on the first connector housing 4 side comes into sliding contact with the sliding contact surface (underside) 250*a* of the rotation prevention pressing portion 250 on the second connector housing 3 side and the rotation prevention lock arm 200 itself is bent downward before the projecting portion 200*b* being locked into another peripheral edge 7*b* of the mounting hole 7 formed on the pillar 2.

Accordingly, the coupled body of the first connector housing 4 and the second connector housing 3 are held at two locations, the one peripheral edge 7*a* and the other peripheral edge 7*b*, of the mounting hole 7 formed on the pillar 2.

While, as shown in FIG. 3C, the temporary locking portion 12 on the first connector housing 4 side and the temporary locking release portion 400 as a temporary lock release means start to come into contact with each other, the temporary locking state into the pillar 2 by the temporary locking portion 12 is still held.

Figure 4C:
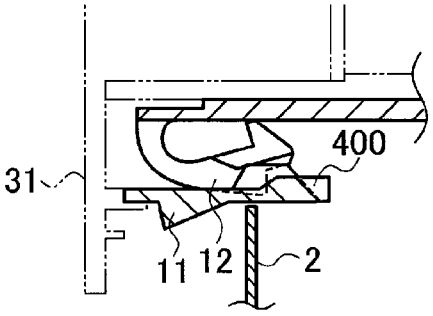
FIG. 4C is an enlarged sectional view of principal portions.
Figure 4D:
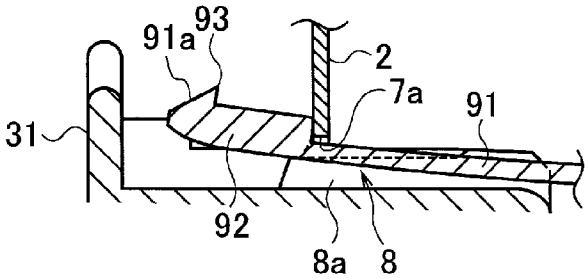
FIG. 4D is an enlarged sectional view of other principal portions.

Next, in the fitting process shown in FIGS. 4A to 4D, the sliding contact of the arm portion 91 of the lock arm 9 on the first connector housing 4 side and the top surface of the rib 8*a* as the lock arm locking portion 8 on the second connector housing 3 side is released and a gap arises between the arm portion 91 and the one peripheral edge 7*a* (see FIGS. 4B and 4D).

The projecting portion 200*b* of the rotation prevention lock arm 200 on the first connector housing 4 side still holds a contact state with the other peripheral edge 7*b* of the mounting hole 7 formed on the pillar 2.

On the other hand, as shown in FIG. 4C, the temporary locking portion 12 on the first connector housing 4 side and the temporary locking release portion 400 as a temporary lock release means come into sliding contact and the temporary locking portion 12 is bent inward (upward in FIG. 4C) and displaced so that the temporary locking state into the pillar 2 by the temporary locking portion 12 is released.

Figure 5A:
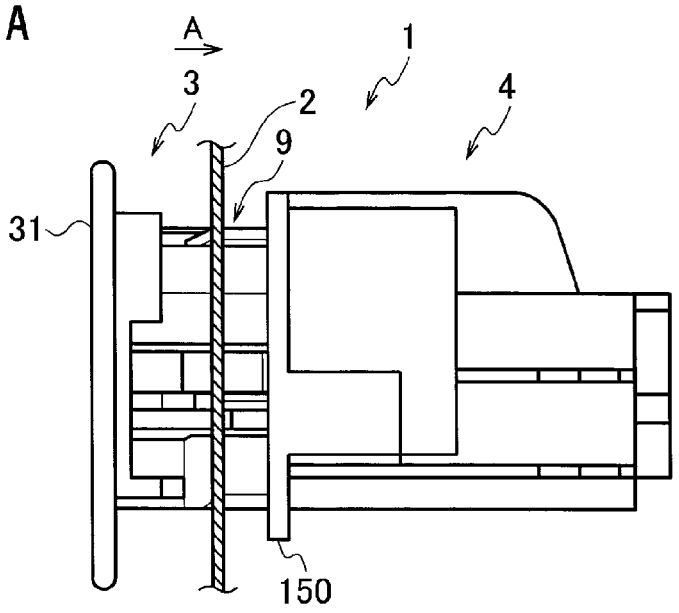
FIG. 5A is a side view showing a continuation of the fitting process of the connector device according to an embodiment of the present invention.
Figure 5B:
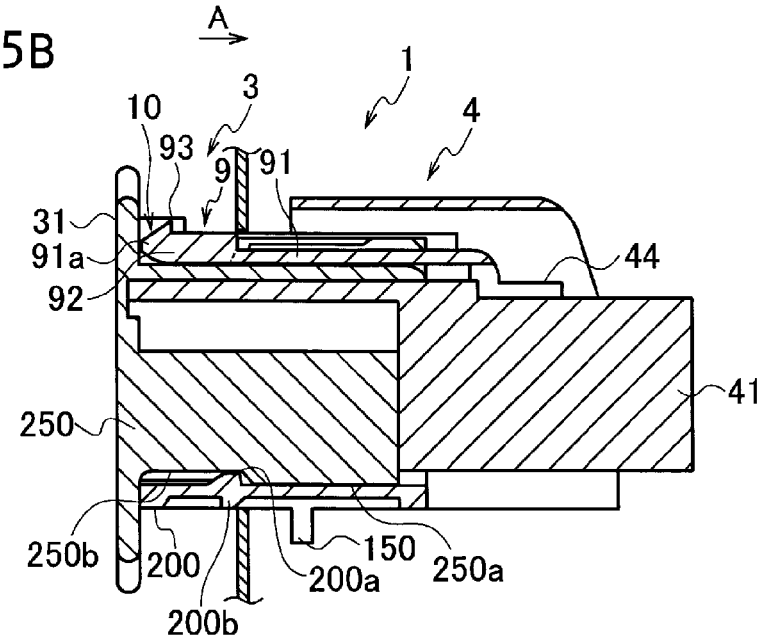
FIG. 5B is a sectional view showing a continuation of the fitting process of the connector device according to an embodiment of the present invention.
Figure 5C:
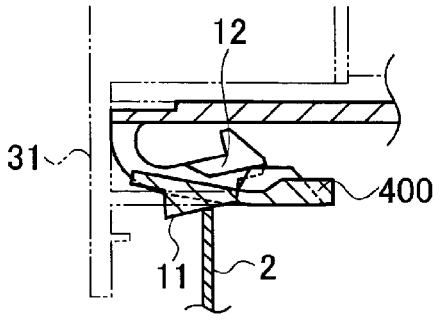
FIG. 5C is an enlarged sectional view of principal portions.

Next, in the fitting process in FIGS. 5A to 5C, the tip portion 91*a* of the lock arm 9 on the first connector housing 4 side is fitted into the fitting portion 10 on the second connector housing 3 side. Accordingly, the coupled body of the first connector housing 4 and the second connector housing 3 is fixed so as not to be separated.

The rotation prevention lock arm 200 on the first connector housing 4 side comes into sliding contact with a sliding contact surface 250*b* whose contact height is different from that of the sliding contact surface 250*a* of the rotation prevention pressing portion 250 and the contact state of the projecting portion 200*b* with the other peripheral edge 7*b* of the mounting hole 7 formed on the pillar 2 is released (see FIG. 5B).

Also, as shown in FIG. 5C, the temporary locking into the pillar 2 by the temporary locking portion 12 is released and the actual locking portion 11 and the peripheral edge of the mounting hole 7 formed on the pillar 2 is not yet engaged.

Figure 6A:
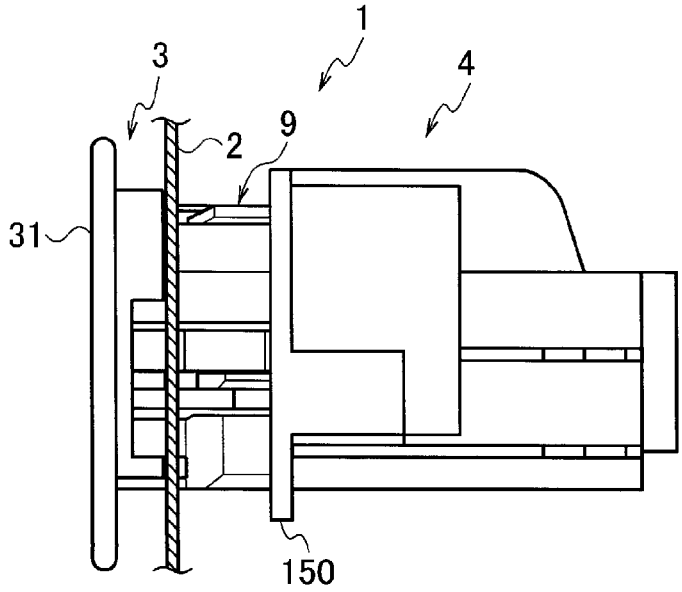
FIG. 6A is a side view showing a complete state of the fitting process of the connector device according to an embodiment of the present invention.
Figure 6B:
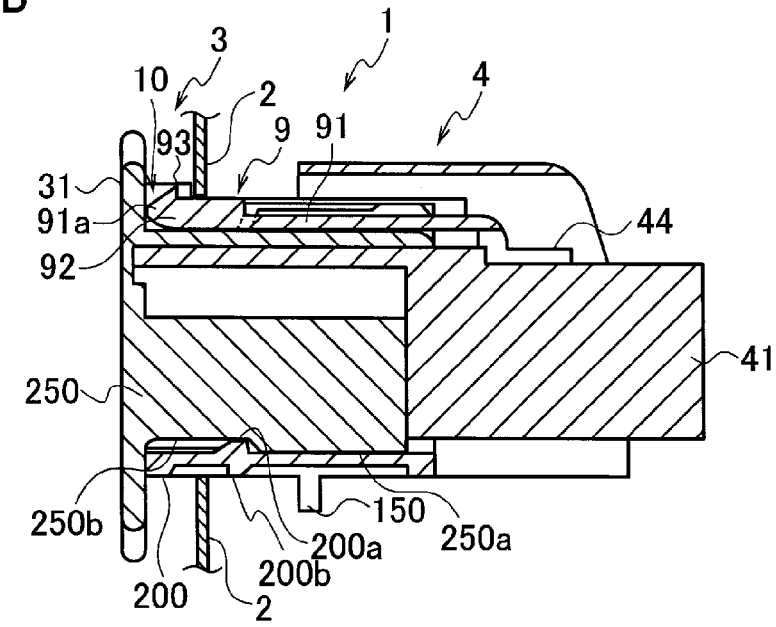
FIG. 6B is a sectional view showing a complete state of the fitting process of the connector device according to an embodiment of the present invention.
Figure 6C:
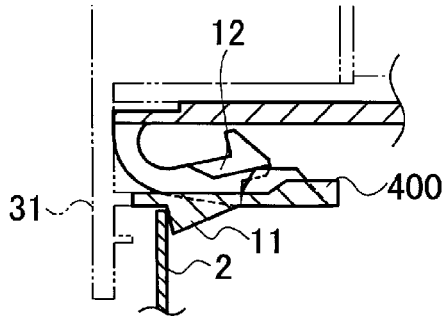
FIG. 6C is an enlarged sectional view of principal portions.

Next, by pressing the coupled body of the first connector housing 4 and the second connector housing 3 in the A direction shown in FIGS. 5A and 5B, as shown in FIGS. 6A to 6C, the flange portion 31 on the first connector housing 4 side is moved to the insertion complete position opposite to the pillar 2 in the neighborhood thereof.

In this state, as shown in FIG. 6C, the actual locking portion 11 on the first connector housing 4 side and the peripheral edge of the mounting hole 7 formed on the pillar 2 are engaged and the connector device 1 is fixed to the pillar 2.

By undergoing the fitting process described above, the fitting of the first connector housing 4 and the second connector housing 3 is completed and also the fixing of the connector device 1 to the pillar 2 is completed.

(Inclination Halfway Through the Fitting of the Connector Device)

Here, the inclination halfway through the fitting of the connector device 1 according to the present embodiment and the inclination halfway through the fitting of the conventional connector 101 are compared.

Figure 13:
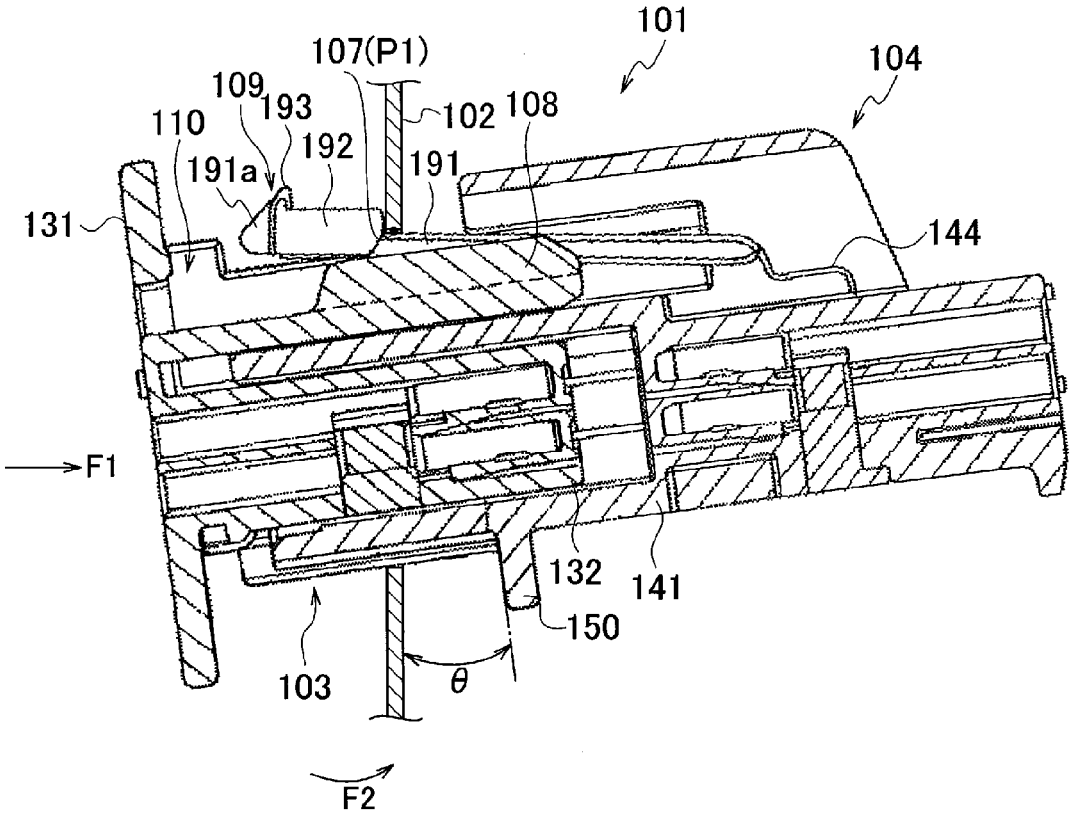
FIG. 13 PRIOR ART
FIG. 13 is an explanatory view showing the physical relationship with respect to the panel in the fitting process of the conventional connector.

First, as described above, if the pressing force F1 in the fitting direction as shown in FIG. 13 is applied to deepen the fitting of the first connector housing 104 and the second connector housing 103 in the conventional connector 101, the turning force F2 around a contact point of the top surface of the arm portion 191 and the peripheral edge of the mounting hole 107 as the supporting point P1 is added to the coupled body of the first connector housing 104 and the second connector housing 103. Thus, an inclination θ with respect to the panel 102 arises in a portion (for example, the projecting portion 150) that should be in parallel with the panel 102. Under the influence of the inclination θ, the vector in the fitting direction is dispersed and the force in the direction in which the first connector housing 104 and the second connector housing 103 are fitted is weakened, inhibiting facilitation and efficiency of fitting work.

Figure 7:
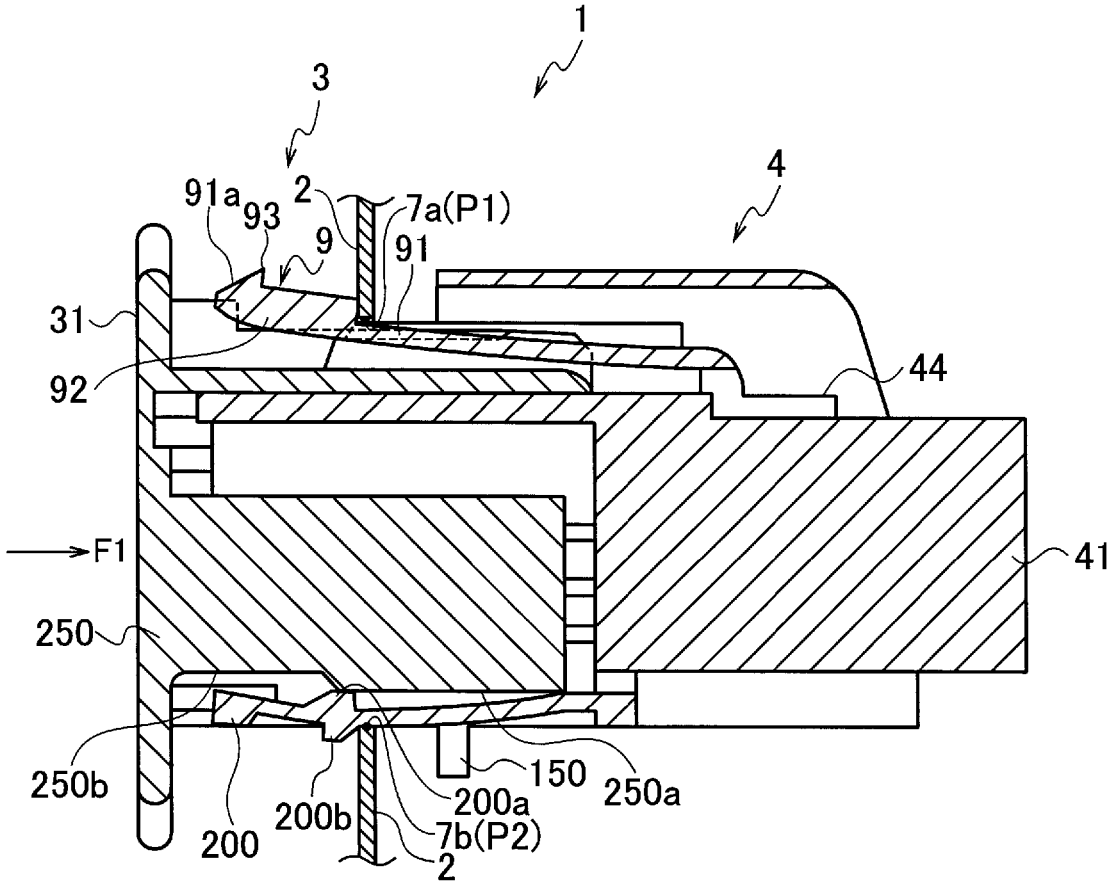
FIG. 7 is an explanatory view showing a physical relationship with respect to a panel in the fitting process of the connector device according to an embodiment of the present invention.
Figure 8:
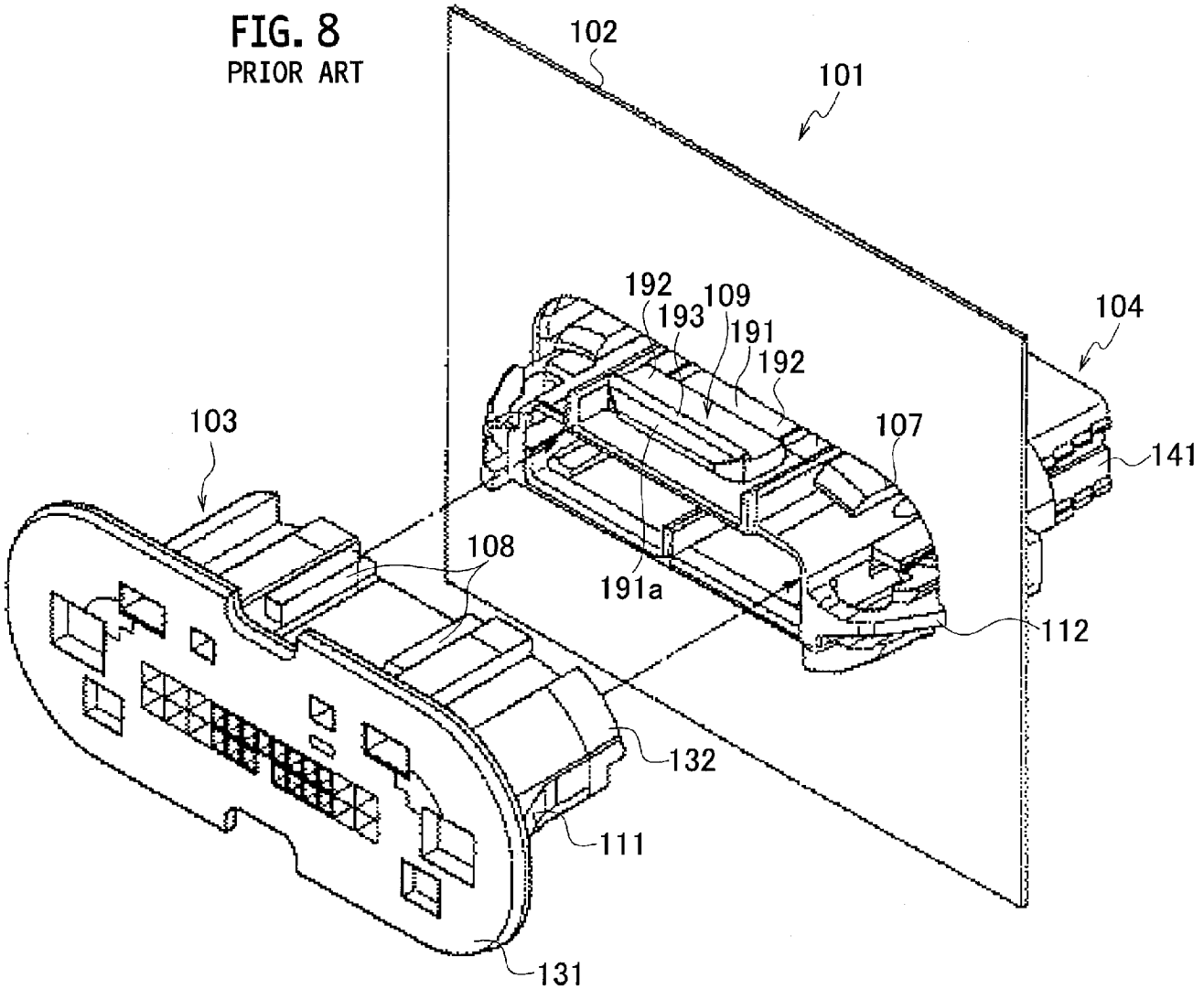
FIG. 8 PRIOR ART
FIG. 8 is a perspective view showing the configuration of a conventional connector.
Figure 9:
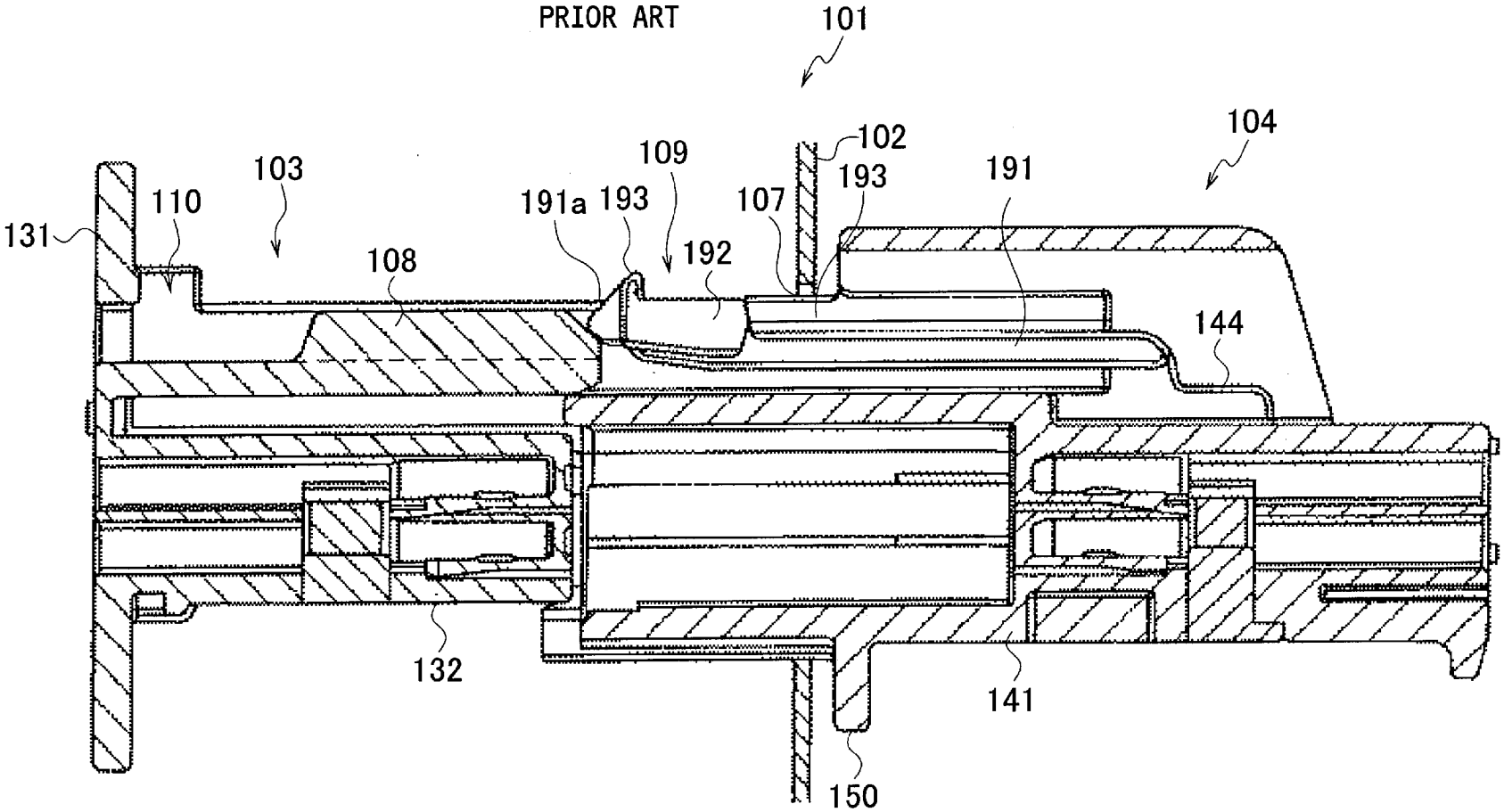
FIG. 9 PRIOR ART
FIG. 9 is a sectional view showing the fitting process of the conventional connector.
Figure 10:
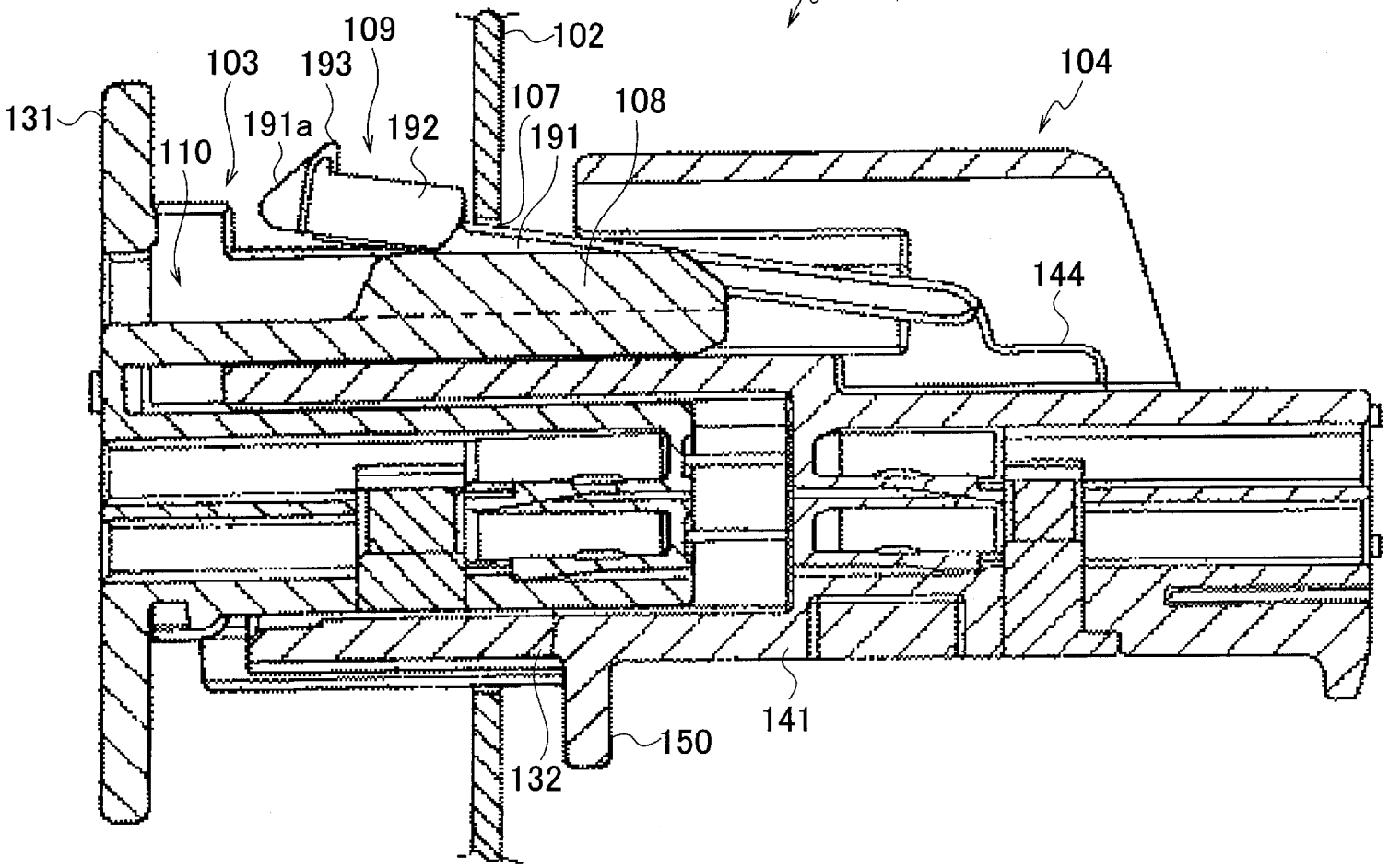
FIG. 10 PRIOR ART
FIG. 10 is a sectional view showing a continuation of the fitting process of the conventional connector.
Figure 11:
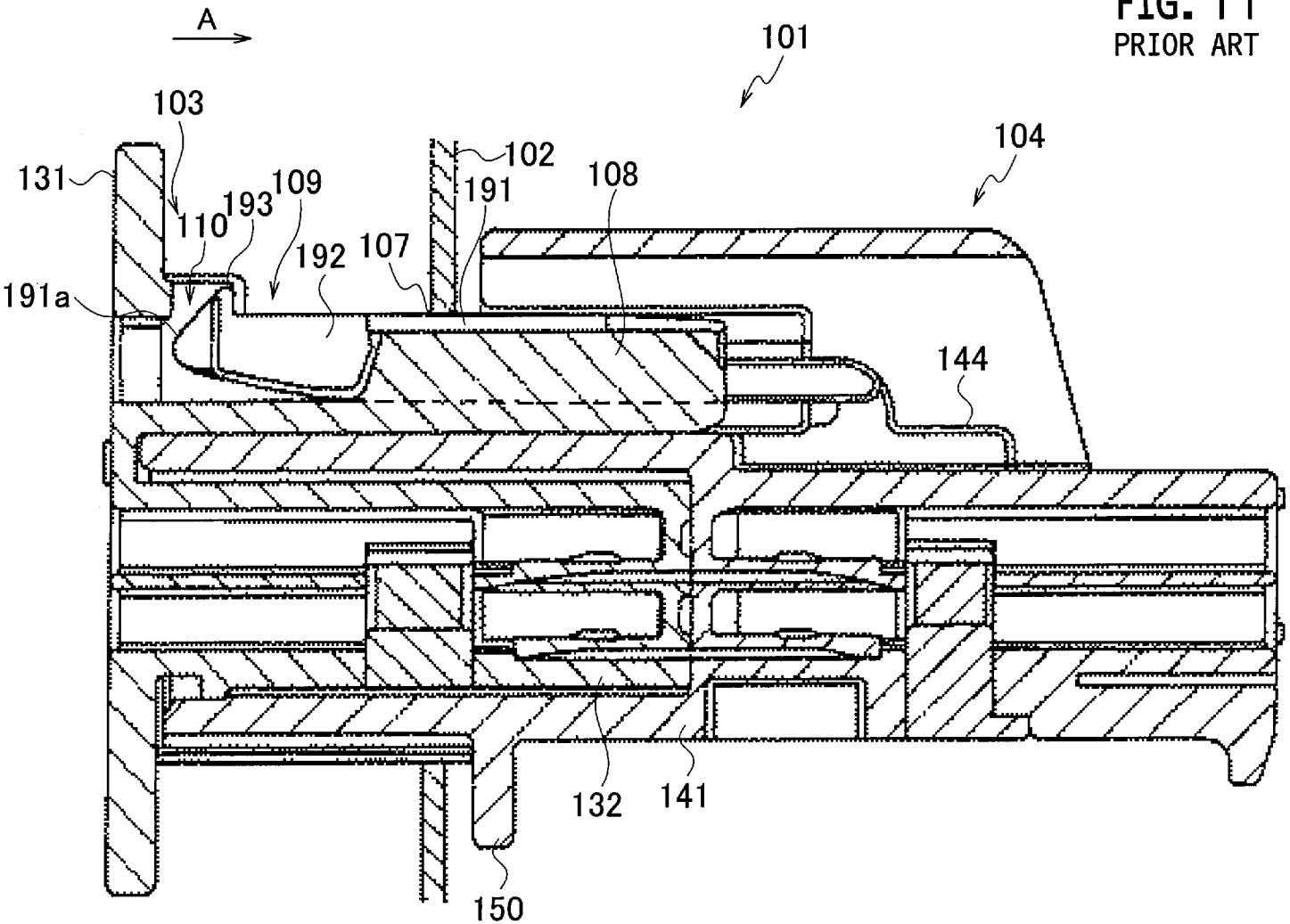
FIG. 11 PRIOR ART
FIG. 11 is a sectional view showing a continuation of the fitting process of the conventional connector.
Figure 12:
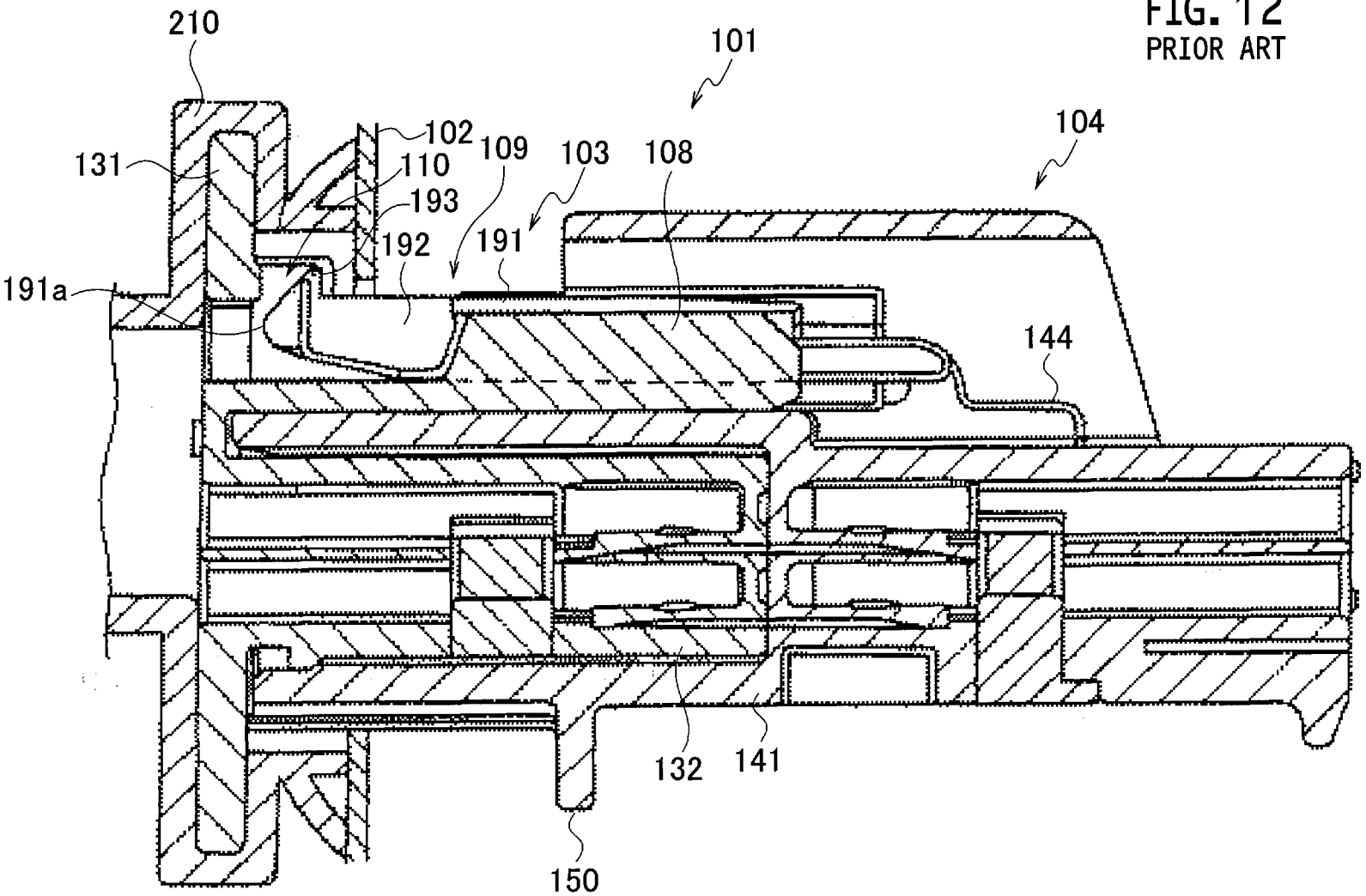
FIG. 12 PRIOR ART
FIG. 12 is a sectional view showing the complete state of the fitting process of the conventional connector.

In the connector device 1 according to the present embodiment, by contrast, as shown in FIG. 7 (corresponding to the fitting process in FIGS. 3B and 4B), the arm portion 91 of the lock arm 9 on the first connector housing 4 side comes into sliding contact with the top surface of the rib 8*a* as the lock arm locking portion 8 on the second connector housing 3 side and the arm portion 91 is bent upward before being pressed against the one peripheral edge 7*a* of the mounting hole 7 formed on the pillar 2 and brought into contact therewith. Then, the projecting portion 200*a* of the rotation prevention lock arm 200 on the first connector housing 4 side comes into sliding contact with the sliding contact surface (underside) 250*a* of the rotation prevention pressing portion 250 on the second connector housing 3 side, the rotation prevention lock arm 200 itself is bent downward, and the projecting portion 200*b* is in contact with the other peripheral edge 7*b* of the mounting hole 7 formed on the pillar 2.

Accordingly, the coupled body of the first connector housing 4 and the second connector housing 3 is held at two locations, the one peripheral edge 7*a* and the other peripheral edge 7*b*, of the mounting hole 7 formed on the pillar 2.

Therefore, as shown in FIG. 7, even if the pressing force F1 in the fitting direction is applied to deepen the fitting of the first connector housing 4 and the second connector housing 3, the rotation of the first connector housing 4 around a contact point of lock arm 9 and the one peripheral edge 7*a* of the mounting hole 7 as the supporting point P1 and the inclination with respect thereto are prevented by the engagement of the rotation prevention lock arm 200 and the other peripheral edge 7*b*, of the mounting hole 7.

Even if the turning force F2 should act on the first connector housing 4 around a contact point of the rotation prevention lock arm 200 and the other peripheral edge 7*b* of the mounting hole 7 as a supporting point P2, the rotation and inclination of the first connector housing 4 itself are prevented by locking of the arm portion 91 of the lock arm 9 and the one peripheral edge 7*a* of the mounting hole 7.

Thus, in the connector device 1 according to the present embodiment, an inclination that disperses a vector in the fitting direction by the pressing force F1 does not arise in a portion (for example, the projecting portion 150) that should be in parallel with the pillar 2.

Therefore, according to the connector device 1 in the present embodiment, circumstances in which the vector of the pressing force F1 in the fitting direction is dispersed and the force in the direction of fitting is weakened as in the past are avoided so that facilitation and efficiency of fitting work can be improved.

In the foregoing, a connector device in the present invention has been described based on an illustrated embodiment, but the present invention is not limited to such an example and the configuration of each unit may be replaced by a unit in any configuration having a similar function.

What is claimed is:

1. A connector device comprising:

a first connector housing having a first body portion, a lock arm, and a temporary locking portion temporarily locked to a peripheral edge of a mounting hole of a mounting member and inserted from one side of the mounting hole; and a second connector housing having a second body portion, a temporary locking release portion that displaces the temporary locking portion to a release position in a fitting process into the first connector housing, a lock arm locking portion that flexurally-deforms the lock arm into a temporary locking state allowing temporary locking to the peripheral edge of the mounting hole and also locks the lock arm, and an actual locking portion that locks to the peripheral edge of the mounting hole in an insertion complete position of the mounting hole, and configured to insert from the other side of the mounting hole, wherein when the second connector housing is fitted into the first connector housing temporarily locked to the peripheral edge of the mounting hole by the temporary locking portion, the lock arm locking portion flexurally-deform the lock arm in the fitting process so as to be temporarily locked to the peripheral edge of the mounting hole, the temporary locking release portion release the temporary locking of the temporary locking portion in the temporary locking state of the lock arm and the peripheral edge of the mounting hole, the lock arm being recovered from flexural deformation when fitted into an inter-connector fitting position to lock the lock arm into the lock arm locking portion, and when the second connector housing moves to an insertion complete position of the mounting hole, the actual locking portion lock to the peripheral edge of the mounting hole, wherein the first connector housing includes a rotation prevention lock arm configured to temporary lock the rotation prevention lock arm to the peripheral edge of the mounting hole and to locate a temporary locking position to a position allowing to prevent rotation around the temporary locking position of the lock arm as a supporting point, the second connector housing includes a rotation prevention pressing portion configured to flexurally-deform the rotation prevention lock arm, and the rotation prevention pressing portion temporarily locks the rotation prevention lock arm to the peripheral edge of the mounting hole in timing when the lock arm locking portion temporarily locks the lock arm to the peripheral edge of the mounting hole.

2. The connector device according to claim 1, wherein the lock arm locking portion of the second connector housing includes a fitting portion configured to fit the lock arm.

3. The connector device according to claim 1, wherein the rotation prevention lock arm has a first projecting portion that flexurally-deforms the rotation prevention lock arm by being brought into sliding contact with the rotation prevention pressing portion, and a second projecting portion temporarily locked to the peripheral edge of the mounting hole by the rotation prevention lock arm being flexurally-deformed.

* * * * *